US007649148B2

(12) United States Patent
Pearson et al.

(10) Patent No.: US 7,649,148 B2
(45) Date of Patent: Jan. 19, 2010

(54) APPLIANCE TIMER MECHANISM UTILIZING SNAP ACTION SWITCHING

(75) Inventors: James E. Pearson, Downers Grove, IL (US); Robert J. Van der Linde, Aurora, IL (US); Thomas J. Davern, St. Charles, IL (US)

(73) Assignee: Robertshaw Controls Company, Carol Stream, IL (US)

( * ) Notice: Subject to any disclaimer, the term of this patent is extended or adjusted under 35 U.S.C. 154(b) by 784 days.

(21) Appl. No.: 11/040,884

(22) Filed: Jan. 21, 2005

(65) Prior Publication Data

US 2006/0163044 A1 Jul. 27, 2006

(51) Int. Cl.
*H01H 43/00* (2006.01)

(52) U.S. Cl. ..... 200/38 R; 200/38 A

(58) Field of Classification Search ..... 200/37 A, 200/38 R, 38 A, 38 F, 38 B, 38 BA, 38 C, 200/38 CA; 74/122–125
See application file for complete search history.

(56) References Cited

U.S. PATENT DOCUMENTS 3,286,924 A * 11/1966 Banathy ..... 200/19.15
3,329,781 A * 7/1967 Wiser ..... 200/38 B
4,767,896 A * 8/1988 Nigg et al. ..... 200/408
6,441,326 B1 * 8/2002 Amonett ..... 200/38 F
6,583,372 B1 * 6/2003 Amonett ..... 200/38 R

* cited by examiner

*Primary Examiner*—Renee S Luebke
*Assistant Examiner*—Marina Fishman
(74) *Attorney, Agent, or Firm*—Reinhart Boerner Van Deuren P.C.

(57) ABSTRACT

A motor driven appliance timer utilizing a cam program disk and snap action switches is provided. The motor may be externally energized, or may be energized based on integrated electronics within the appliance timer. Rotation of the program disk by a user to allow selection of a desired appliance cycle is accommodated by a clutch subassembly that allows bidirectional rotation of the program disk without requiring that the user pull or push the control shaft before rotating the program disk. The timer of the present invention may utilize either impulse or constant drive mechanisms to rotate the program disk. The use of snap action switches minimizes the possibility of tack weld failures due to switch teasing.

13 Claims, 13 Drawing Sheets

APPLIANCE TIMER MECHANISM UTILIZING SNAP ACTION SWITCHING

FIELD OF THE INVENTION

This present invention relates generally to appliance timer mechanisms, and more particularly to appliance timer mechanisms utilizing motor driven cams to provide multiple operating cycles for the appliance.

BACKGROUND OF THE INVENTION

Consumer appliances continue to increase in complexity in response to consumer demands. For example, the typical consumer clothes dryer includes multiple drying cycles, heat levels, etc. to handle the ever growing array of different fabrics and clothes types owned by consumers. From traditional timed cycles to more complex moisture sensing automatic cycles, from towels to delicate silks, from hot to no-heat fluff, the controllers for these consumer appliances are required to provide such functionality while not increasing the cost or reducing the reliability of the appliance itself.

Currently, dryer timers utilize one of two different configurations. The first configuration, which has been used for the North American market for the past twenty to forty years, utilizes a drum with separate cams attached. The cams are free to rotate up to about one degree. When the switches ride over the cams they rotate slightly and cause a quick make or brake. This helps prevent the switches from welding from a slow make or brake. This drum stack is always in contact with the switches and the motor. However, the cam stack is able to be rotated separate from the motor via a clutch between the motor and the cam stack.

The second configuration of dryer timer, which is a newer version, uses an on-off line switch. This on-off line switch is similar to washer mechanical timers utilized in the North American market. In this design, when the user is setting the timer, the cams are removed from the switches by pulling the user interface knob to disengage the cams from the switches. This allows the cam drops to be sharp, and eliminates the need for cams with free motion. Unfortunately, most users are not used to having to push and pull the timer shaft to set the dryer cycle, and then push a separate button to start the dryer. As such, this second design has enjoyed little success in the North American market.

There exists, therefore, a need in the art for a new dryer timer that eliminates the old, bulky, drum cam stack without requiring a user to push-pull the timer shaft to set a particular appliance cycle. These and other advantages of the invention, as well as additional inventive features, will be apparent from the description of the invention provided herein.

BRIEF SUMMARY OF THE INVENTION

In view of the above, it is an object of the present invention to provide a new and improved appliance timer. More particularly, it is an object of the present invention to provide a new and improved appliance timer utilizing a single piece cam design. More particularly, it is an object of the present invention to provide a new and improved appliance timer utilizing a single cam disk that may be rotated to select an appliance cycle without requiring the timer shaft to be pushed and/or pulled to effectuate such cycle selection. It is a still further object of the present invention to provide a new and improved appliance timer that allows bidirectional movement of the cam disk without creating any switch teasing that may result in tack weld failures of the switch contacts.

In view of the above, an embodiment of an appliance timer constructed in accordance with the teachings of the present invention utilizes an AC synchronous motor, a single cam disk, a clutch for bidirectional movement, a dial in spring, a case, cover, and miniature snap action switches. For added functionality, a preferred embodiment of the present invention also includes a printed circuit board (PCB) that includes electronics to control the energization of the motor for positioning of the cam disk to control various appliance functions such as, e.g., auto dry.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

While the preceding and following description of a preferred embodiment of the present invention refers to the use of the appliance timer of the instant invention in a consumer clothes dryer, those skilled in the art will appreciate that the appliance timer of the present invention may also be utilized with other types of appliances that require programmatic control. Therefore, the foregoing and following examples should be taken by way of example and not by way of limitation.

Figure 1:
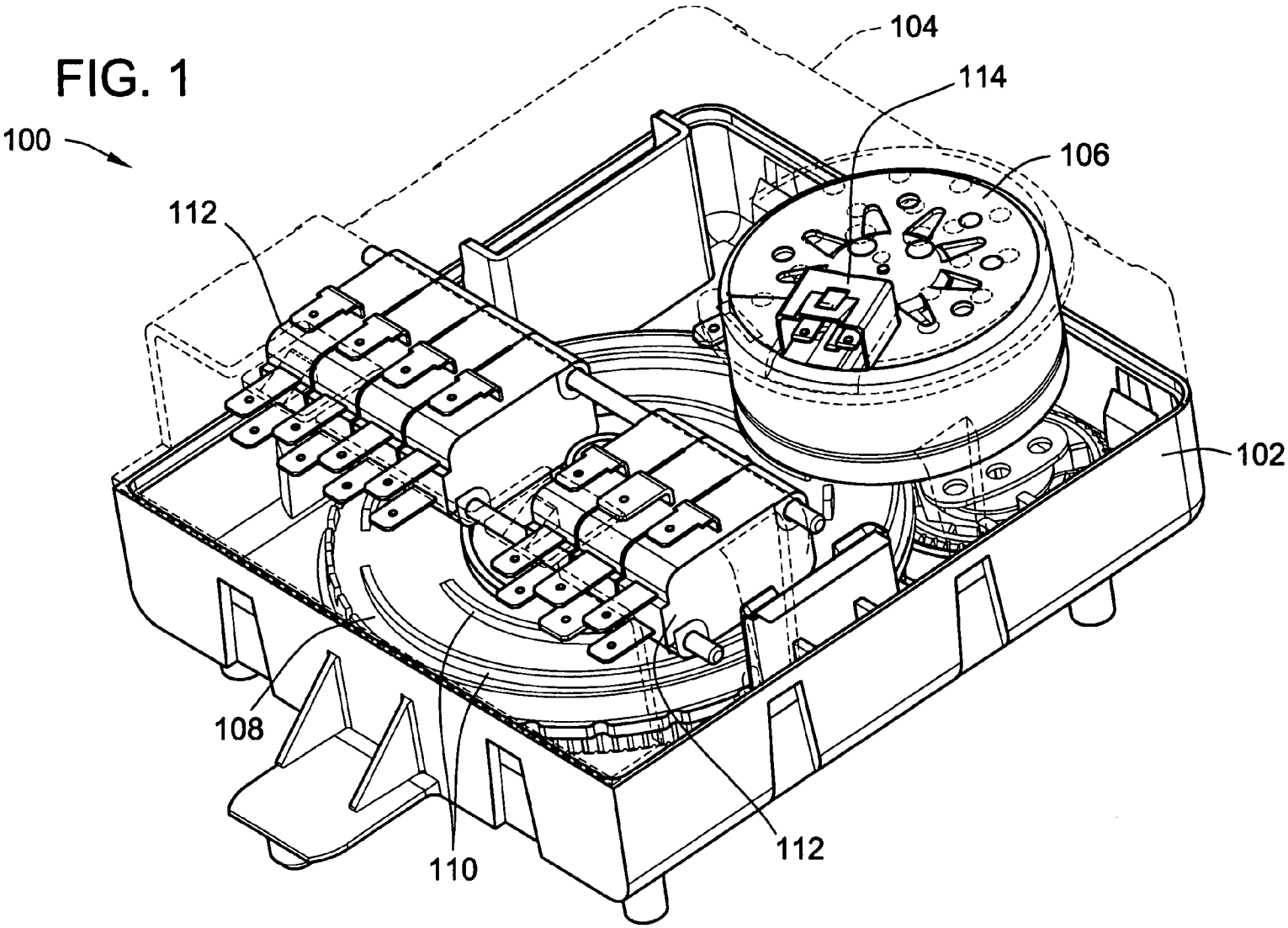
FIG. 1 is a partial isometric illustration of an appliance timer constructed in accordance with the teachings of the present invention.

Turning to FIG. 1, there is illustrated an embodiment of an appliance timer 100 of the present invention in partial transparent form to show the various components thereof. In this embodiment of the appliance timer 100, the components thereof are housed within a housing including a base 102 and a cover 104 (shown in FIG. 1 in transparent form). The particular components housed in each of the base 102 and cover 104 will be made clear in the following description.

As may be seen from this FIG. 1, an embodiment of the appliance timer 100 utilizes a motor 106 which may be, advantageously, an AC synchronous motor. The motor 106 drives, through an appropriate drive mechanism as will be discussed more fully below, a cam program disk 108. This cam program disk 108 includes a plurality of program tracks 110 at various radial positions thereon. These program tracks 110 include raised and lowered portions that function to transition the various switches 112. These switches 112 are positioned with their actuation mechanisms corresponding to one of the plurality of program tracks 110. In a preferred embodiment of the present invention, the switches 112 are snap-action switches that provide a rapid opening and closure to prevent switch teasing as the cam program disk 108 is rotated in either direction (by the motor 106 or by a user). In the embodiment of the appliance timer 100 illustrated in FIG. 1, seven separate switches are utilized to provide programmed switching at various times as dictated by the individual program tracks 110 on the cam program disk 108.

As illustrated in FIG. 1, the motor 106 includes a motor power connection 114. This motor power connection 114 provides the energization to the motor 106 to rotate the cam program disk 108. The control for this input power may be provided by a separate appliance controller, or may be provided through a series of appliance interlocks and/or control switches. In any event, once the motor 106 receives power through connector 114, it will operate to rotate the cam program disk 108. As the cam program disk 108 rotates, the rises and falls of the various program tracks 110 will cause sequenced switching of the plurality of switches 112.

Figure 2:
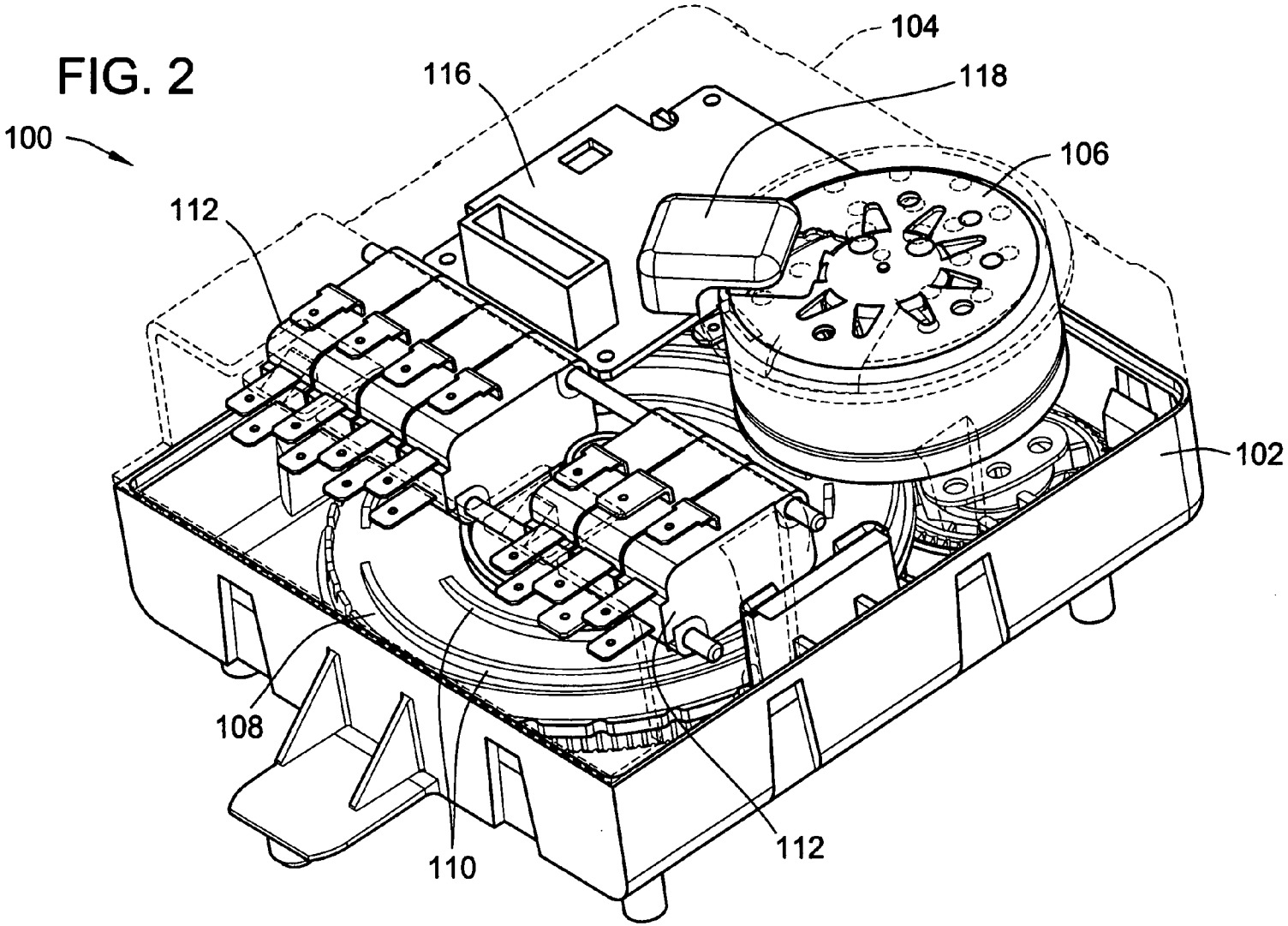
FIG. 2 is a partial isometric illustration of an alternate embodiment of an appliance timer constructed in accordance with the teachings of the present invention including a printed circuit board to provide additional functionality.

As illustrated in FIG. 2, the control for motor 106 may be provided by an integrated printed circuit board (PCB) 116. Such a PCB 116 includes electronics that control the energization of motor 106 to provide advanced functionality. In this alternate embodiment, the appliance timer 100 also includes an insert section 118 of the cover mold 104 to protect the connection from the PC board 116 to the motor 106. In another alternate embodiment, the cover is designed to fit both the PCB version and the non-PCB version without requiring an insert in the mold.

To allow the user to rotate the cam program disk 108 to a particular program setting, a clutch subassembly 120 is provided. This clutch subassembly 120 includes a clutch spring 122 that provides a coupling force between a motor shaft drive receptacle 124 and a cam program disk drive gear 126. Such a clutch subassembly 120 allows the user to rotate the cam program disk 108 without back driving the motor 106. Once the consumer has selected the desired appliance program cycle, the motor 106 is then able to drive the cam program disk 108 by rotating the cam program disk drive gear 126 through the clutch subassembly 120.

The rotational position of the desired appliance cycle is typically confirmed by aligning the user interface knob (not shown) with a visual graphic on the front panel of the appliance. To provide tactile feedback to the consumer of the position of various cycles, a dial indicator spring 128 may also be included in this base portion 102. This dial indicator spring 128 cooperates with position indicator notches 130 positioned on the cam program disk 108, preferably around the outer periphery thereof. As the user rotates the cam program disk 108, the dial indicator spring 128 will engage each of the indicator notches 130 in succession to provide a tactile feedback to the user. The positioning of these indicator notches 130 may be customized based on the programming provided by the appliance timer 100.

Figure 3:
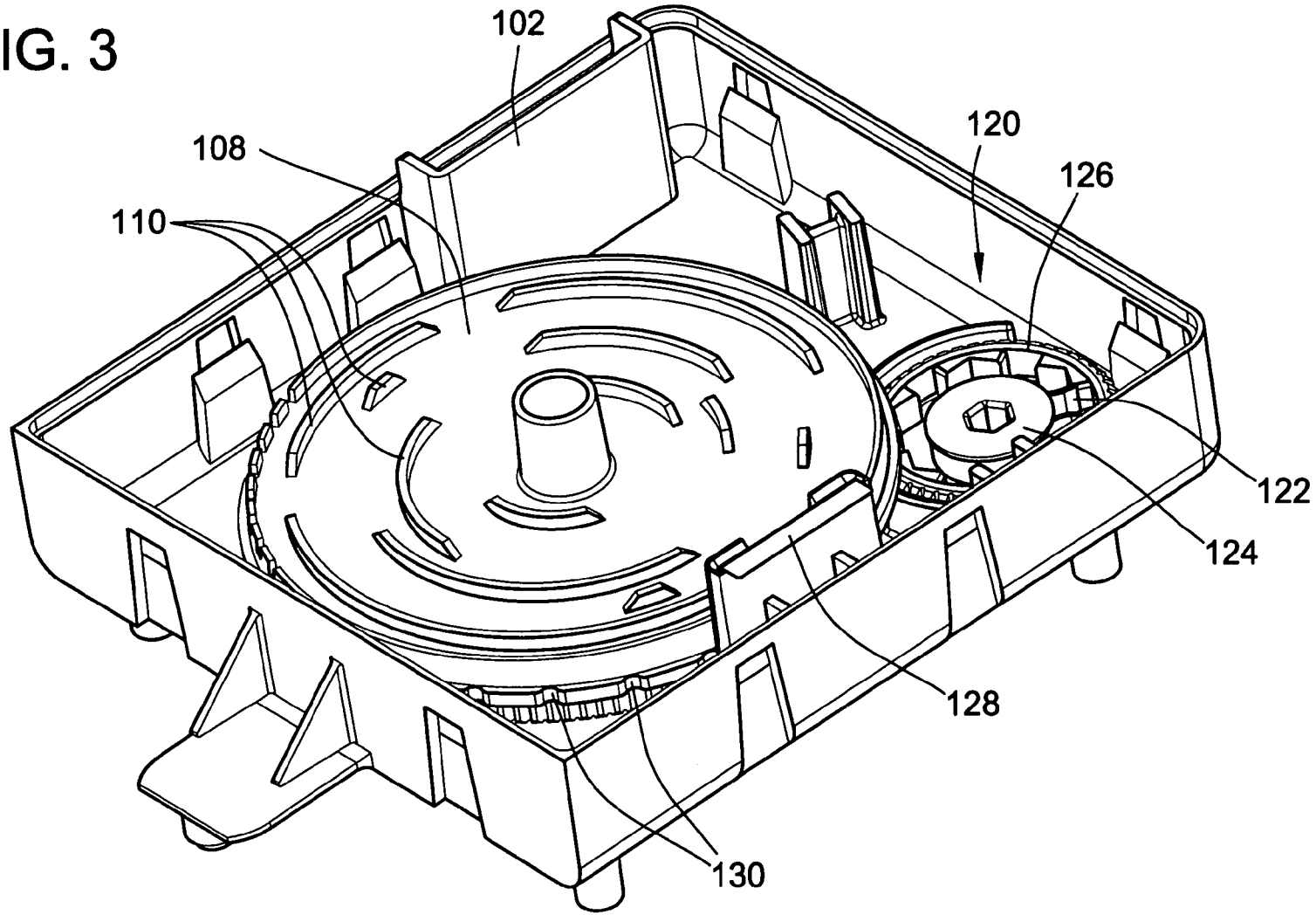
FIG. 3 is an isometric view of the appliance timer of FIGS. 1 and 2 illustrating the program disk, clutch assembly, and dial in spring.
Figure 4:
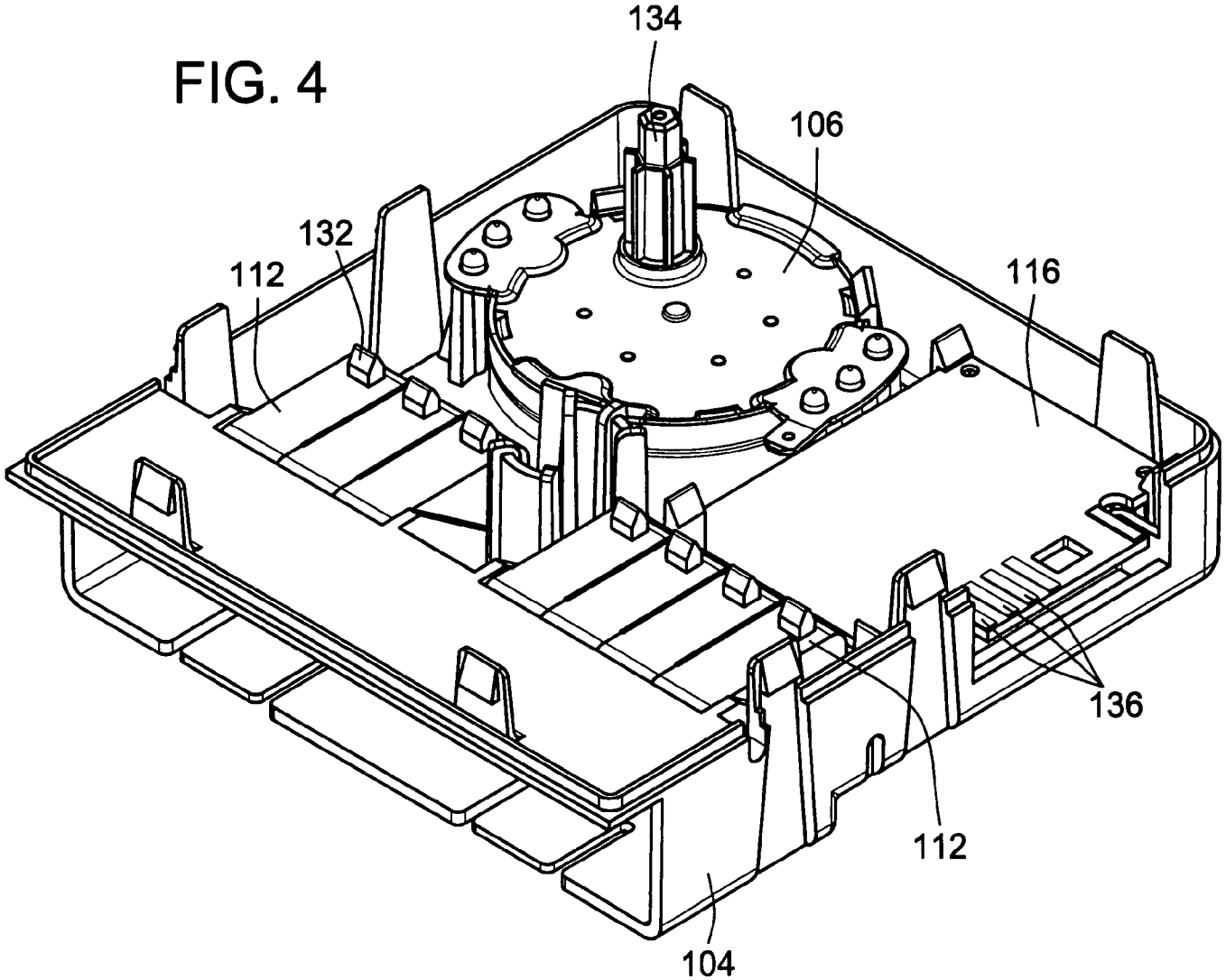
FIG. 4 is a partial isometric illustration of the appliance timer of FIG. 2 illustrating the cover subassembly including the motor, micro switches, and auto dry PCB.

FIG. 4 illustrates the appliance timer cover assembly of the embodiment of the appliance timer 100 illustrated in FIG. 2. Specifically, as may be seen from the underside of this cover subassembly 104, each of the switches 112 has a switch actuator 132. These switch actuators 132 include angled surfaces that allow the program tracks 110 of the cam program disk 108 to transition the switch actuators 132 from a fully extended to a fully depressed position as the program disk 108 is rotated in either direction. This allows the user to rotate the user interface knob (not shown) in either direction to select the desired appliance control cycle. By utilizing such angled surfaces, the cam program tracks 110 may also include sharp cam drops, which allows for more programmatic information to be included on each cam track. As may also be seen from FIG. 4, the motor 106 includes a motor output shaft 134 which is accommodated in the slot of the motor shaft drive receptacle 124 illustrated in FIG. 3 to rotate the cam program disk drive gear 126 through the clutch subassembly 120 to rotate the cam program disk 108. As may also be seen from this FIG. 4, the PC board 116 also includes a number of connector contacts 136 to provide input and output information and power. These connector contacts 136 may be located in a convenient location based on installation needs, e.g. on the edge as shown in FIG. 4, on the top of the timer 100, etc.

Figure 5:
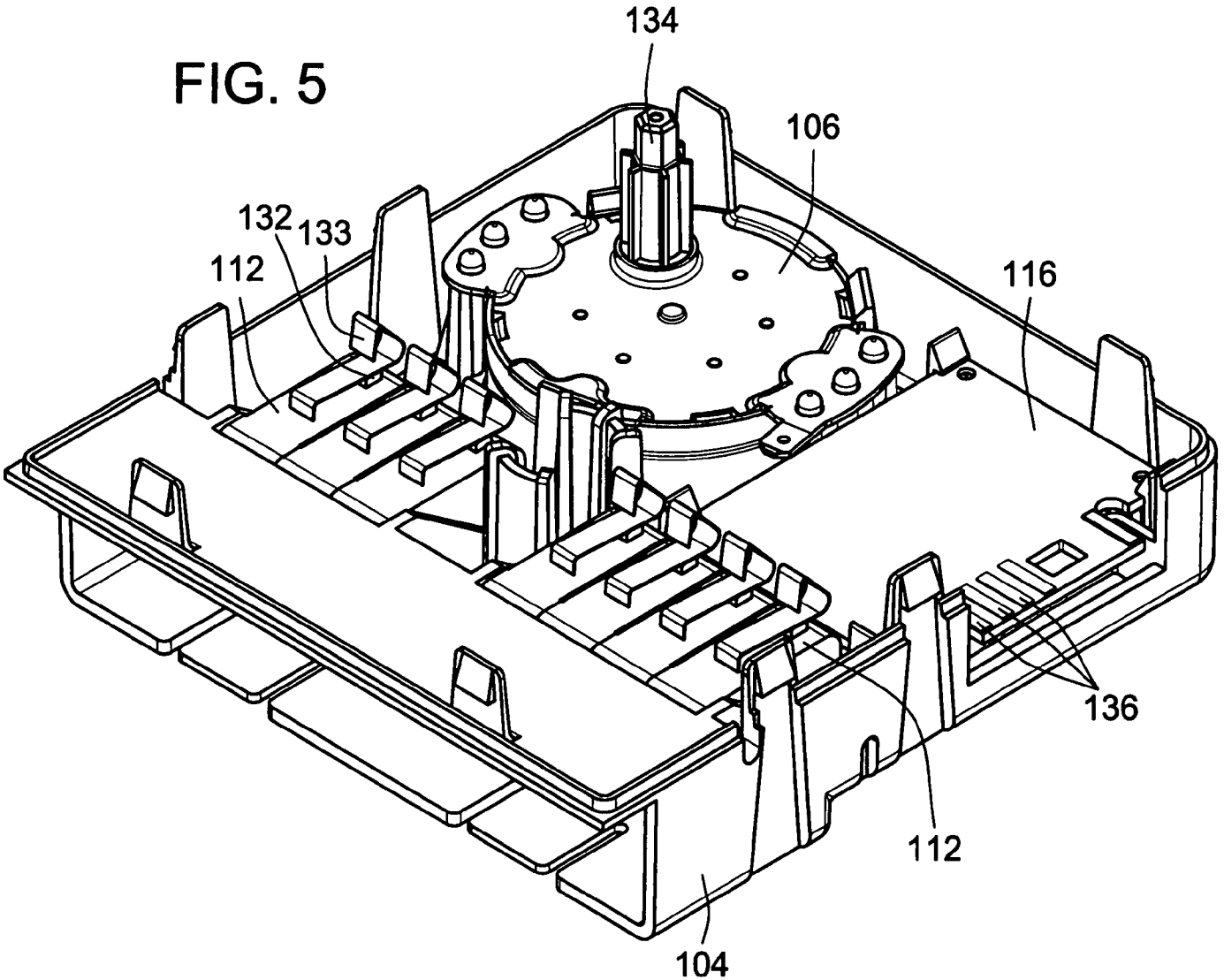
FIG. 5 is a partial isometric illustration of an alternate embodiment of the appliance timer of FIG. 2 illustrating the cover subassembly including the motor, micro switches including snap switch levers, and auto dry PCB.

FIG. 5 illustrates the appliance timer cover assembly of an alternate embodiment of the appliance timer 100 illustrated in FIG. 2. Specifically, as may be seen from the underside of this cover subassembly 104, each of the switches 112 has a switch actuator 132 and a switch lever 133 to facilitate actuation of the switch. These switch levers 133 include angled cam track contact surfaces that allow the program tracks 110 of the cam program disk 108 to transition the switch actuators 132 via the levers 133 from a fully extended to a fully depressed position as the program disk 108 is rotated in either direction. This allows the user to rotate the user interface knob (not shown) in either direction to select the desired appliance control cycle. By utilizing such angled surfaces, the cam program tracks 110 may also include sharp cam drops, which allows for more programmatic information to be included on each cam track. In one embodiment these switch levers 133 are made from spring steel. This allows the lever 133 itself to act as a snap mechanism. As such, the switches 112 may be normal micro switches, and need not include a snap action mechanism therein; although this combination is not precluded. The provision of these switch levers 133 provides fast switch activation, thus preventing premature switch failure.

Figure 6:
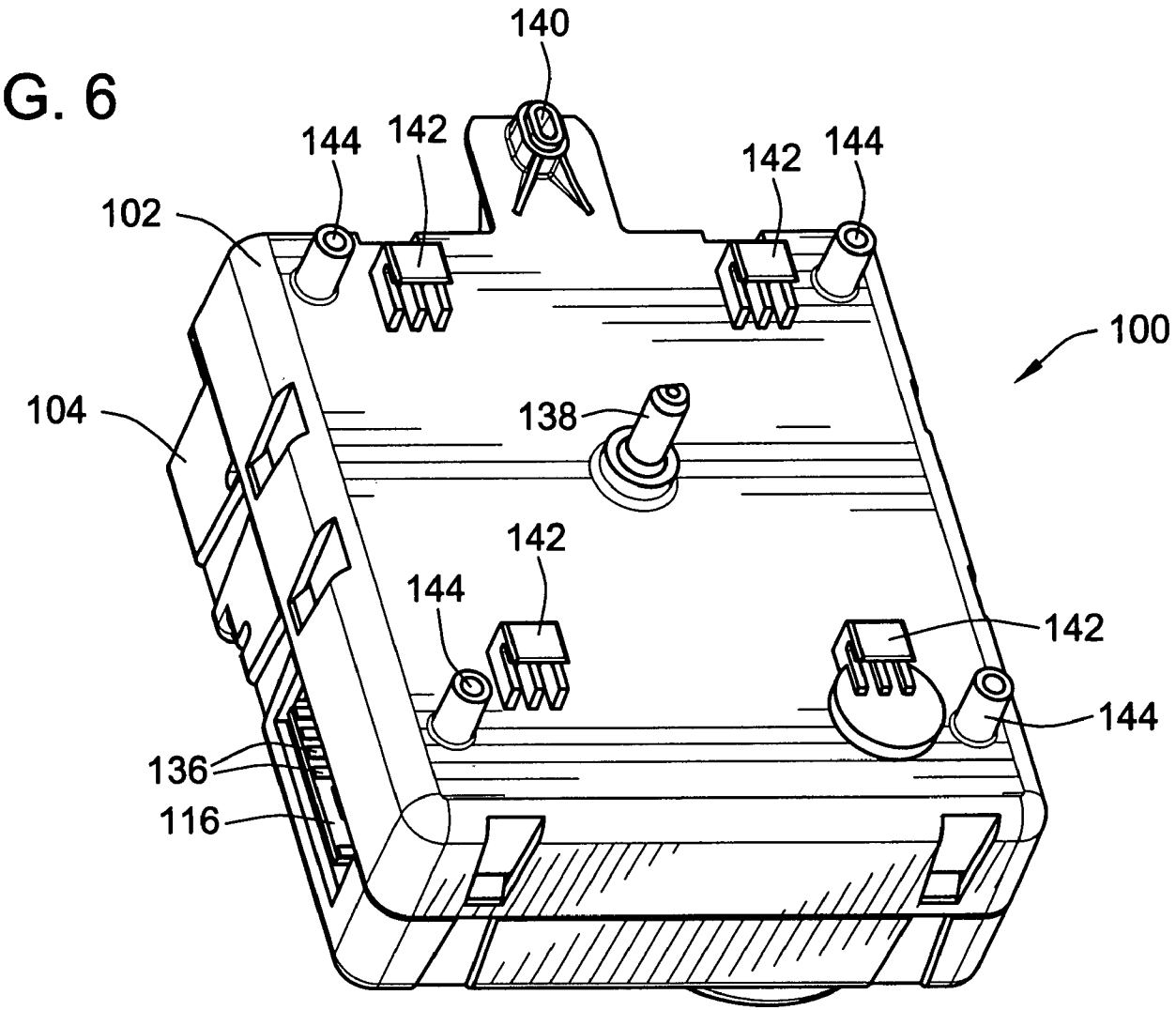
FIG. 6 is an isometric illustration of a completed appliance timer assembly illustrating the program shaft adapted to receive a user interface knob to allow user setting of the position of the cam program disk.

Once assembled, the appliance timer assembly 100 may be positioned behind the control panel of the appliance via locking tab 140, mounting feet 142, and/or guide posts 144 as illustrated in FIG. 6. The front control panel typically includes an aperture through which the cam program disk shaft 138 extends. The user interface knob (not shown) is inserted onto the shaft 138 to provide both a visual indication of the rotational position of the cam program disk 108 and also to provide the user with a mechanism to position the cam program control disk 108 in a desired appliance cycle.

Figure 7:
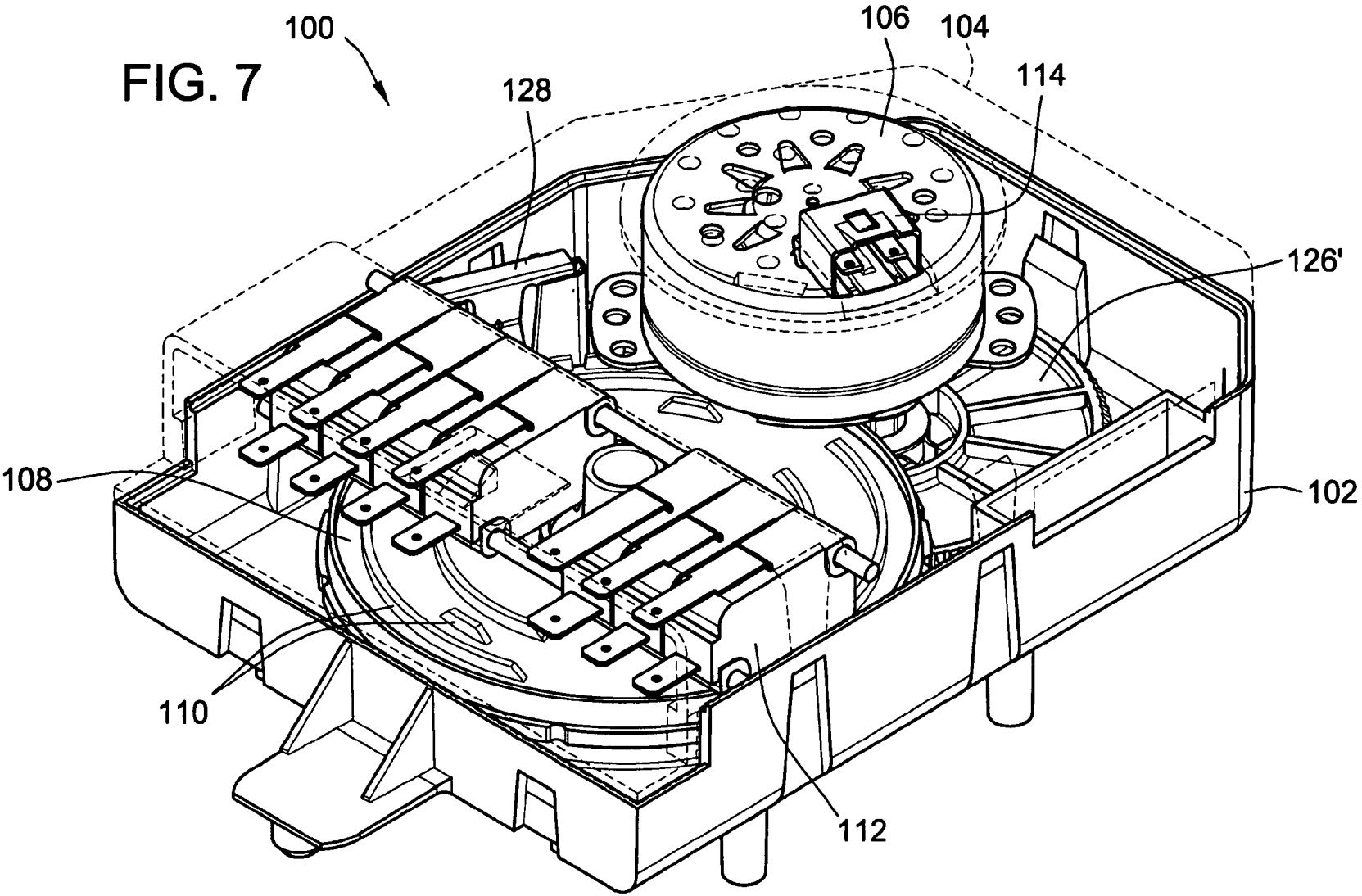
FIG. 7 is a partial isometric illustration of a further alternate embodiment of an appliance timer constructed in accordance with the teachings of the present invention.
Figure 8:
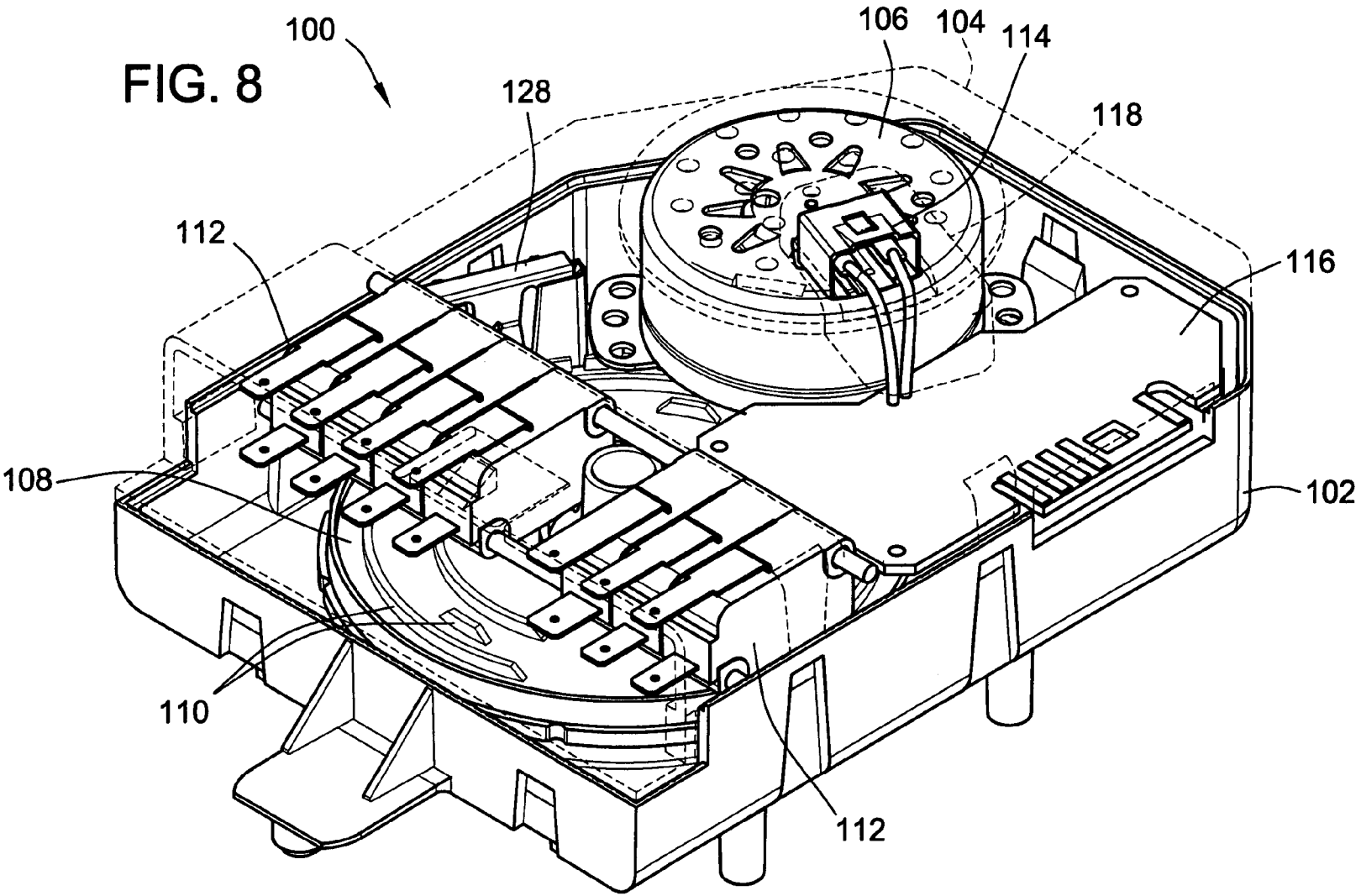
FIG. 8 is a partial isometric illustration of an alternate embodiment of the appliance timer of FIG. 7 constructed in accordance with the teachings of the present invention including a PCB to provide additional functionality.

An alternate embodiment of the appliance timer 100 of the present invention is illustrated in FIG. 7. This embodiment utilizes the cam program disk 108 with its cam program tracks 110 to actuate a series of switches 112 in similar manner to the embodiment discussed above. However, in this configuration the cam disk drive gear 126' differs from that of the previous embodiments. In this alternate configuration, the motor 106 may be externally driven via connector 114 as illustrated in FIG. 7, or may be driven by the PCB 116 as illustrated in FIG. 8.

Figure 9:
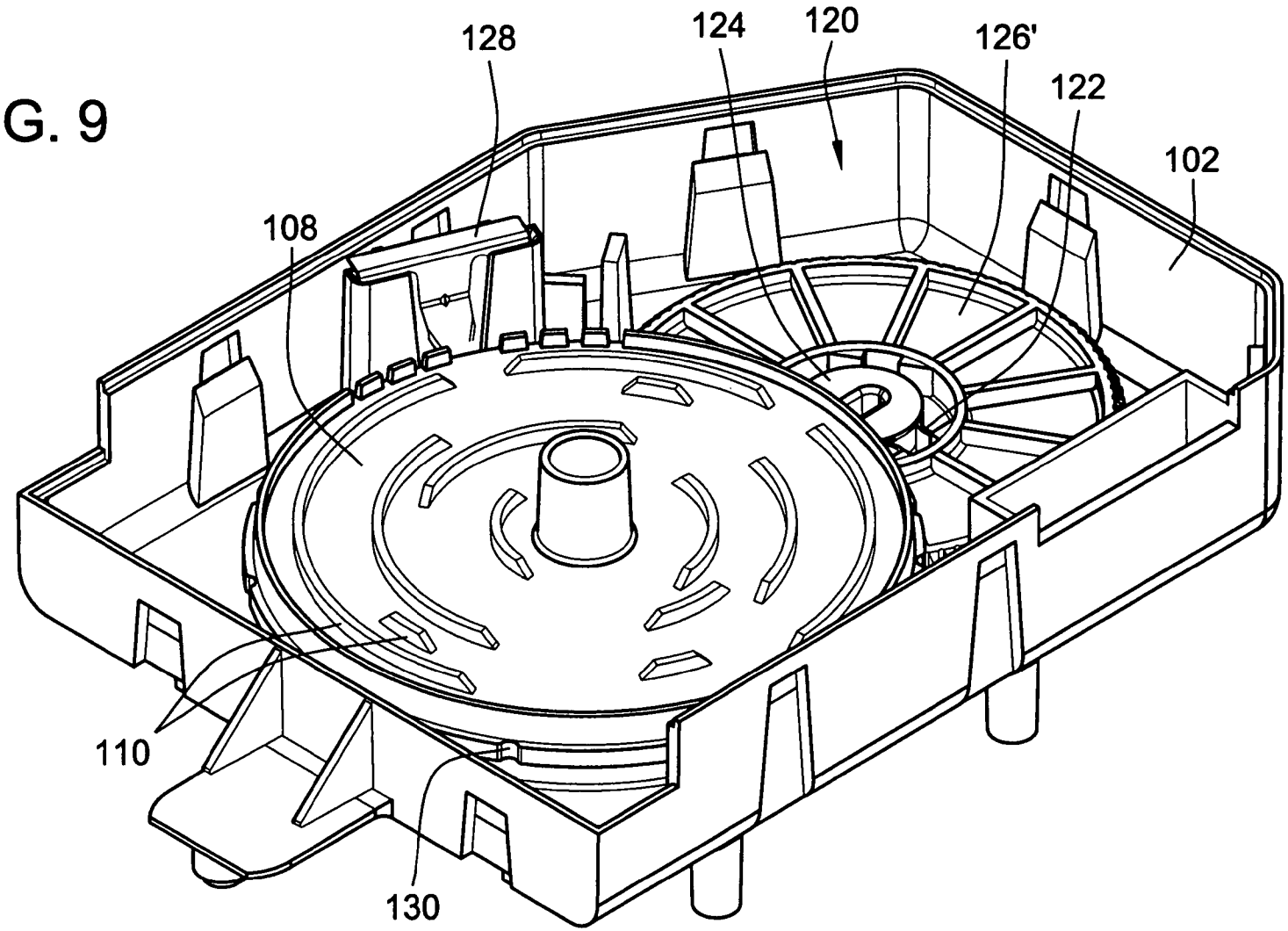
FIG. 9 is an isometric view of the appliance timer of FIGS. 6 and 7 illustrating the program disk, clutch assembly, and dial in spring.

The difference in the cam program disk drive gear 126' may be seen more clearly from FIG. 9. Unlike the previous embodiment discussed above (see FIG. 3), in this embodiment of the present invention the drive gear 126' has a much larger diameter with gear teeth around its outer periphery to drive the cam program disk 108. This allows for continuous rotation of the cam program disk 108 while the motor 106 is energized. As will be recognize from the foregoing by those skilled in the art, the embodiment illustrated in FIG. 3 will result in non-continuous or impulse rotation of the cam program disk 108. This difference in drive type may be better understood form an examination of FIGS. 11 and 12 which illustrate the clutch subassemblies of these two embodiments.

Figure 12:
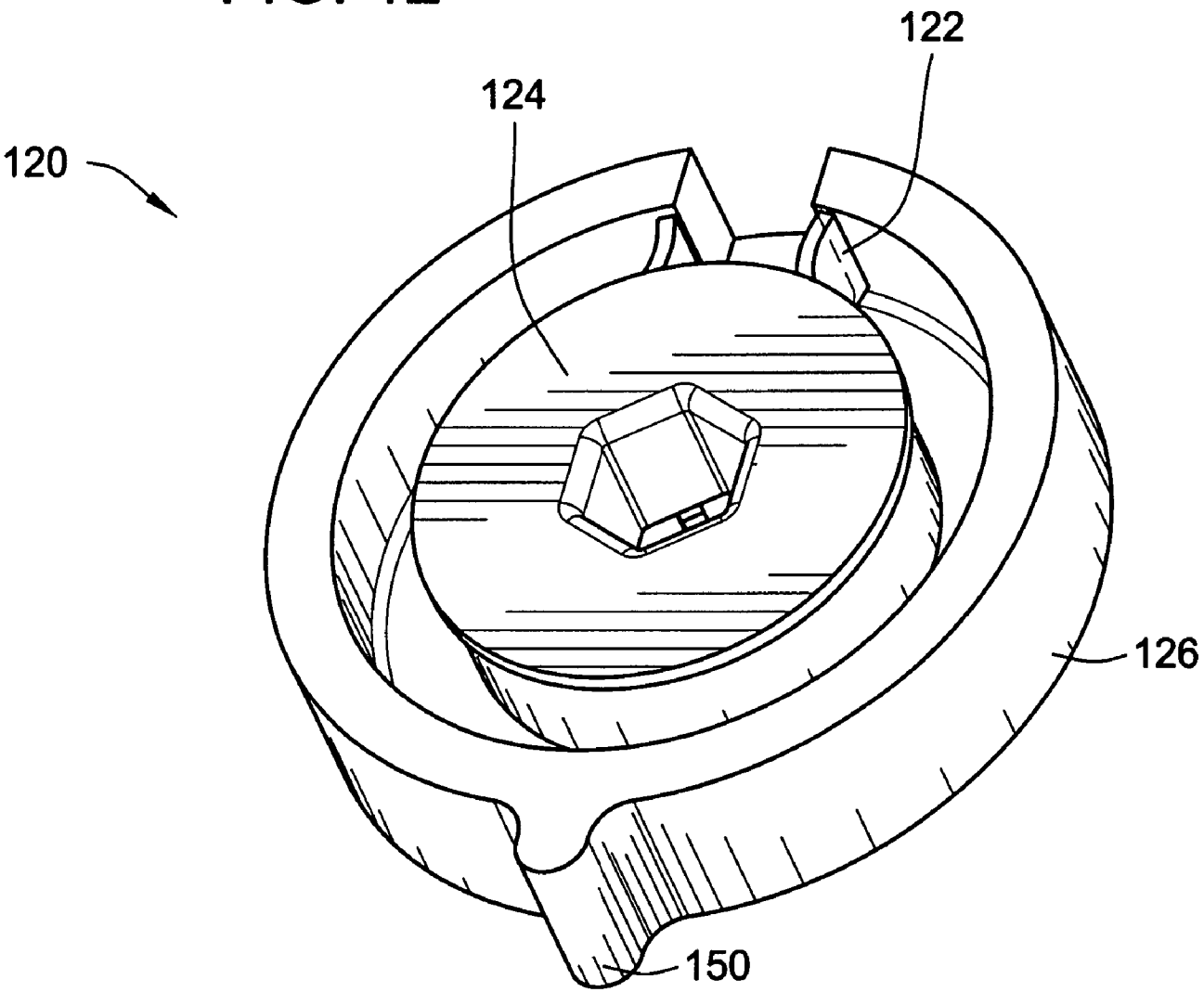
FIG. 12 is an isometric illustration of a clutch assembly of one embodiment to the present invention.

As illustrated in FIG. 12, the cam program disk drive gear 126 includes a single tooth 150. As the motor 106 rotates the drive gear 126 through the clutch subassembly, the tooth 150 periodically engages the cam program disk 108 to rotate it a given amount during the period of engagement. This indexing or pulsing rotates the cam program disk 108 a given amount to progress through the various appliance cycles governed by the program tracks 110 of the cam program disk 108.

Figure 13:
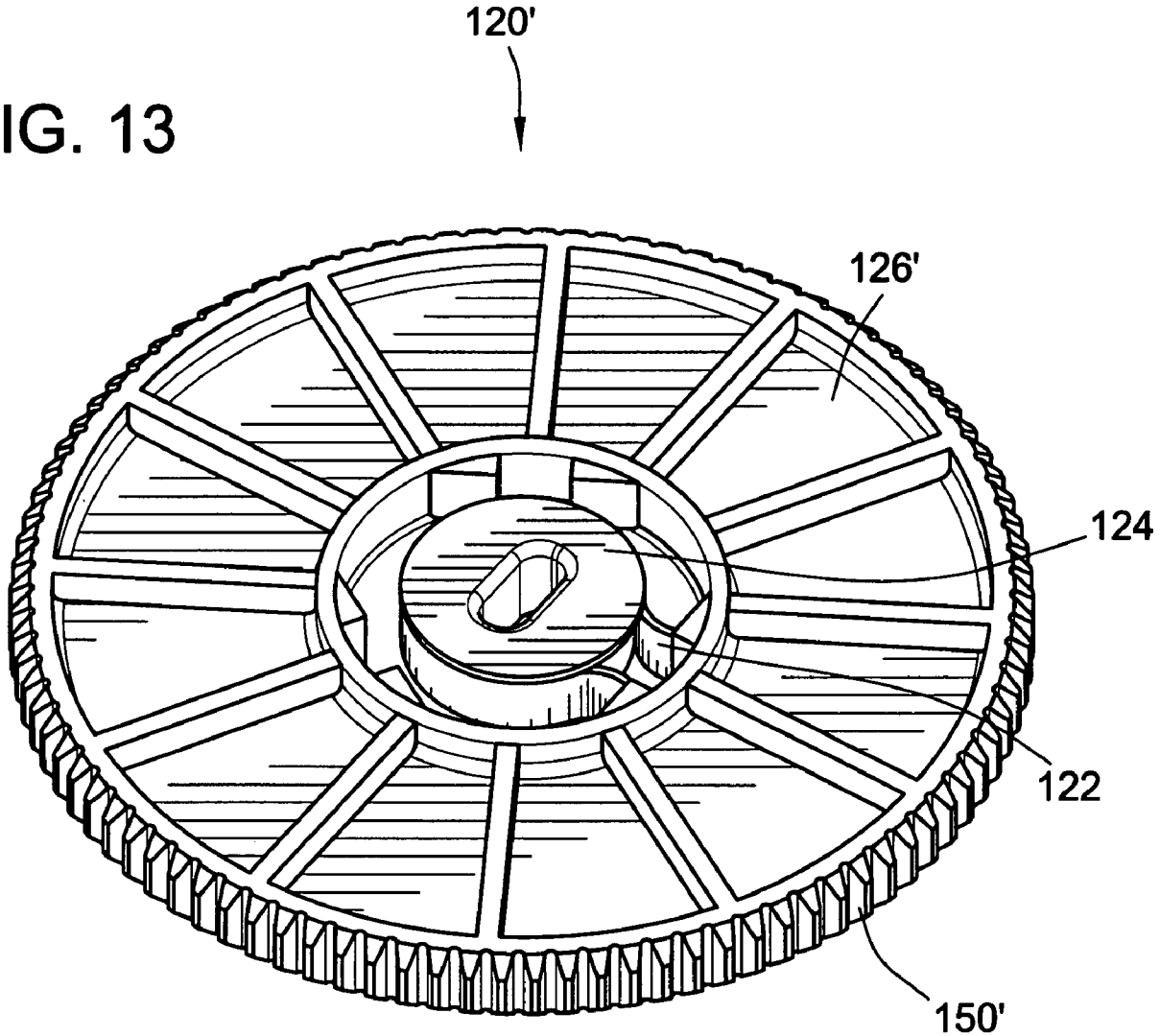
FIG. 13 is an isometric illustration of a clutch assembly for an alternate embodiment of the present invention.

Unlike the indexing or impulse drive provided by the clutch subassembly 120 of FIG. 12, the clutch subassembly 120' illustrated in FIG. 13 provides a lighter feel due to a 2:1 gear reduction provided by the drive gear 126'. Unlike the single tooth drive gear 126 illustrated in FIG. 12, the drive gear 126' of FIG. 13 includes a plurality of teeth 150' around the outer periphery of the drive gear 126'. In this way, the cam program disk 108 is continuously rotated during the period of motor energization.

Figure 10:
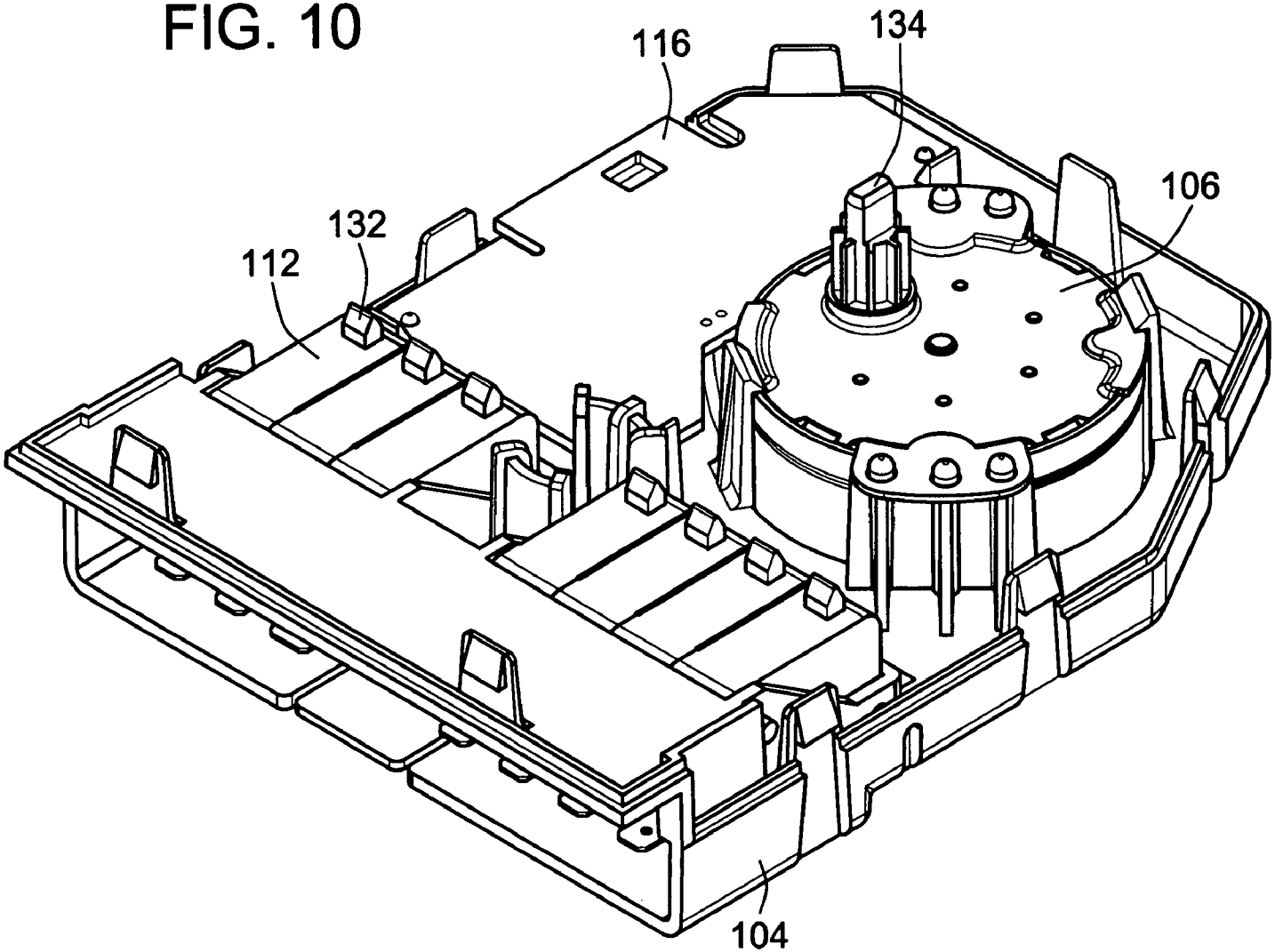
FIG. 10 is a partial isometric illustration of the appliance timer of FIG. 8 illustrating the cover subassembly including the motor, micro switches, and auto dry PCB.

As illustrated in FIG. 10, the appliance timer cover subassembly 104 also includes the switches 112, the motor 106, and the optional PCB 116. As with the previous embodiment, the switches 112 also include switch actuators 132 that are positioned relative to the cam program tracks 110 to provide sequenced operation of the switches 112 during the appliance cycles dictated by the cam program disk 108. The motor 106 also includes an output shaft 134, although the positioning of this output shaft is varied from that illustrated in the previous embodiment to drive the cam program disk drive gear 126'.

Figure 11:
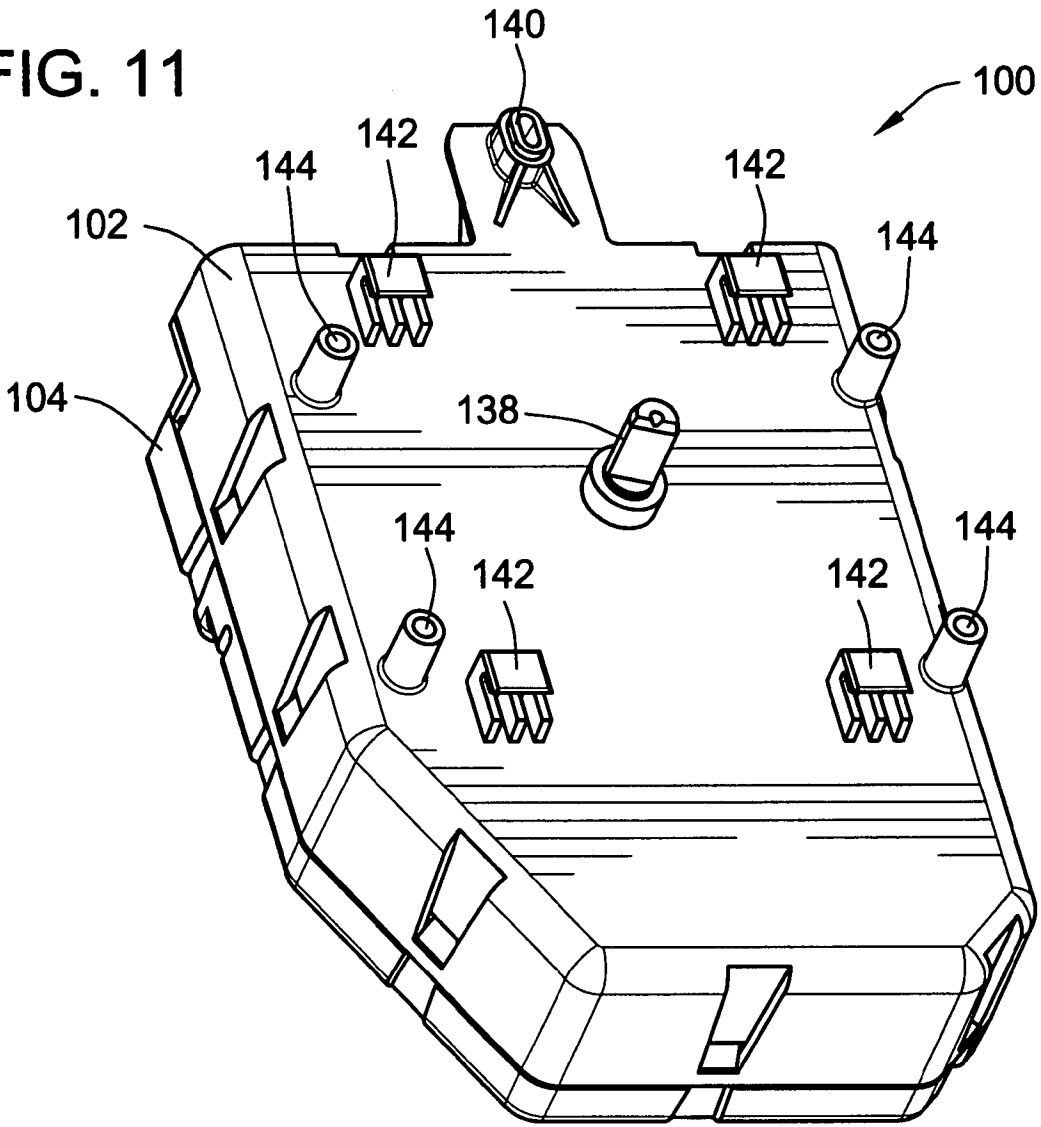
FIG. 11 is an isometric illustration of a completed appliance timer assembly of FIG. 8 illustrating the program shaft adapted to receive a user interface knob to allow user setting of the position of the cam program disk.

FIG. 11 illustrates the mounting configuration of this alternate embodiment of the appliance timer 100. As with the previous embodiment, the program disk output shaft 138 is adapted to accommodate a user interface knob. This knob will provide visual indication of the current appliance cycle, as well as providing the user with the ability to rotate the program disk 108 to a desired appliance cycle.

As will now be apparent to those skilled in the art from the foregoing, the appliance timer of the present invention provides significant advantages over prior appliance timers. Specifically, the appliance timer of the present invention enables custom dial in points through the cooperation of the dial indicator spring 128 and notches 130 of the cam program disk 108. The appliance timer of the present invention also provides a customizable feel that can vary from model to model by varying the configuration of the drive gear 126. The mounting configuration of the appliance timer of the present invention also provides the advantage by allowing screw-less, slide in mounting to the control panel of the appliance. The single connection for the switches also reduces the change of improper wiring during installation. The ability of each of the embodiments of the present invention to accommodate the addition of electronic circuits internal to the timer also provides added functionality without varying the external configuration of the timer housing. The use of the sealed snap action switches minimizes the risk of tack weld failures resulting from switch teasing, and enables bidirectional rotation of the cam program disk 108 by the user and/or by the motor.

As also is apparent from the foregoing, the appliance timer of the present invention may include a constant drive or an impulse drive based on the clutch subassembly configuration. With the constant drive embodiment switching can be done at any program location, and the dial in points can be located anywhere as desired. The constant drive also provides very slow make and brake speed as may be desired in certain applications. The impulse drive embodiment typically results in faster make and brake speeds, and switching is preferably done within thirty-six impulses. The dial in points may also be located within or between impulses. With the impulse drive, the appliance timer typically includes reduced switch tolerance compared to the constant drive embodiment.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An appliance timer comprising:

a motor having an output shaft;

a cam program disk having thereon at least one cam program track;

at least one switch having a switch actuator positioned in operative communication with the at least one cam program track, wherein the switch actuator remains in operative communication with the cam program disk while manually positioning the cam program disk, and a program disk drive gear operably coupling the output shaft to the cam program disk to rotate the cam program disk, wherein the at least one switch is a snap-action switch.

2. An appliance timer of comprising:

a motor having an output shaft;

a cam program disk having thereon at least one cam program track;

at least one switch having a switch actuator positioned in operative communication with the at least one cam program track, wherein the switch actuator remains in operative communication with the cam program disk while manually positioning the cam program disk, and a program disk drive gear operably coupling the output shaft to the cam program disk to rotate the cam program disk, wherein the program disk drive gear comprises at least one tooth on an outer periphery thereof, the at least one tooth engaging the cam program disk to provide rotation thereto, and wherein the program disk drive gear comprises a plurality of teeth on the outer periphery thereof, and wherein the plurality of teeth are spaced around the outer periphery so as to provide an impulse drive to the cam program disk.

3. An appliance timer of comprising:

a motor having an output shaft;

a cam program disk having thereon at least one cam program track;

at least one switch having a switch actuator positioned in operative communication with the at least one cam program track, wherein the switch actuator remains in operative communication with the cam program disk while manually positioning the cam program disk, and a program disk drive gear operably coupling the output shaft to the cam program disk to rotate the cam program disk, wherein the switch actuator comprises two angled surfaces configured to allow bidirectional rotation of the cam program disk.

4. An appliance timer, comprising:

a motor;

a cam program disk having thereon a plurality of program tracks;

a plurality of snap-action switches corresponding to the plurality of program tracks, each snap-action switch positioned in operative communication with an associated cam program track; and wherein the motor is operably coupled to the cam program disk to rotate the cam program disk.

5. The appliance timer of claim 4, wherein the motor is operably coupled to the cam program disk via a clutch subassembly to allow rotation of the cam program disk by a user without back-driving the motor.

6. The appliance timer of claim 5, wherein the clutch subassembly includes a cam program disk drive gear having at least one tooth thereon configured to engage the cam program disk to rotate same.

7. The appliance timer of claim 6, wherein the cam program disk drive gear includes a plurality of teeth continuously engaging the cam program disk to provide a constant drive thereto.

8. The appliance timer of claim 4, wherein each snap-action switch comprises a switch actuator operably coupled to a switch lever, the switch lever positioned to follow the cam program track.

9. The appliance timer of claim 8, wherein the switch lever comprises spring steel to provide a snap-action actuation of the switch actuator.

10. An appliance timer, comprising:

a motor;

a cam program disk having thereon a plurality of program tracks;

a plurality of snap-action switches corresponding to the plurality of program tracks, each snap-action switch having a switch actuator positioned in operative communication with an associated cam program track; and wherein the motor is operably coupled by a clutch to the cam program disk to allow the motor to rotate the cam program disk and to allow the cam program disk to be rotated by a user in either direction without back-driving the motor.

11. The appliance timer of claim 10, wherein each of the snap-action switches further comprises a switch lever operably positioned between the switch actuator and the associated cam program track.

12. The appliance timer of claim 11, wherein the switch lever comprises spring steel to provide a snap-action actuation of the switch.

13. The appliance timer of claim 6, wherein the at least one tooth periodically engages the cam program disk to provide an impulse drive thereto.

* * * * *